United States Patent [19]

Aikens et al.

[11] Patent Number: 5,031,080

[45] Date of Patent: Jul. 9, 1991

[54] PORTABLE COCKPIT LIGHT ASSEMBLY

[75] Inventors: Wallace R. Aikens, Plano, Tex.; Stephen A. Sharp, Wilson; James K. Stawitzky, North Tonawanda, both of N.Y.

[73] Assignee: Gulton Industries, Inc., Plano, Tex.

[21] Appl. No.: 528,971

[22] Filed: May 24, 1990

[51] Int. Cl.[5] ..... F21V 9/04

[52] U.S. Cl. ..... 362/62; 362/187; 362/284; 362/293

[58] Field of Search ..... 362/284, 282, 293, 187, 362/208, 322, 324, 18, 62

[56] References Cited

U.S. PATENT DOCUMENTS

| | | | |
|---|---|---|---|
| 2,874,269 | 2/1959 | Greenlee | 362/293 |
| 3,426,189 | 2/1968 | Deputy | 362/293 |
| 3,843,878 | 10/1974 | Ueda et al. | 362/293 |
| 4,175,279 | 11/1979 | Asaki | 362/18 |
| 4,580,196 | 4/1986 | Task | 362/62 |
| 4,602,321 | 7/1986 | Bornhorst | 362/293 |
| 4,794,494 | 12/1988 | Reeder | 362/293 |
| 4,829,407 | 5/1989 | Bushell et al. | 362/293 |

*Primary Examiner*—Ira S. Lazarus
*Assistant Examiner*—Richard R. Cole
*Attorney, Agent, or Firm*—Darby & Darby

[57] ABSTRACT

A portable incandescent light assembly having a selectably interposable filter is disclosed. The light assembly is particularly applicable to night vision situations for airplane pilots. The light assembly comprises a housing in which a light source and a filter for filtering out infra-red light are located. The light assembly further comprises a mechanism for rotating the filter within the housing between a filtering position in which the filter is disposed across a light output axis and a non-filtering position in which the filter is disposed parallel to the light output axis.

16 Claims, 4 Drawing Sheets

PORTABLE COCKPIT LIGHT ASSEMBLY

BACKGROUND OF THE INVENTION

The present invention concerns a portable incandescent light assembly with a selectably interposable filter. For example, it may be capable of interposing a colored filter in the path of a white-light source, or of providing white light either with or without infra-red light.

The present invention is particularly applicable to situations involving night vision for airplane pilots. For such night vision, it has been common to provide infra-red search-lights on an airplane, for viewing outside scenes. The pilot may be provided with sensitive infra-red nightvision goggles, which can view the intra-red-illuminated scenes. However, infra-red sources within the airplane (such as instrument panel lights) may interfere with viewing through the plane windscreen by causing reflections of undesired infra-red light into the night vision goggles. During such night-vision situations, it is also desirable to be able to read maps or the like, as during flight. For example, a co-pilot may desire to view a map under visible light while the pilot is wearing night-vision goggles. Under these circumstances a source of infra-red light in the cockpit would interfere with the pilot's functioning.

The present light assembly provides a blue or green filter, which in one position filters out infra-red light (e.g. an Anvis Green A light) from an incandescent lamp while allowing visible light to pass. In this situation, the light emission from the light assembly does not add to infra-red radiation within the cockpit and so does not interfere with the pilot's night-vision functioning. In a second position, the present invention permits emission of unfiltered white light (including infra-red light) from the lamp for ordinary use where night-vision is not a factor.

The present invention is particularly concerned with the control of a filter, to flip it between a position across the axis of the light assembly (where the filter is interposed in the path of the light output to filter out undesired light) to a position parallel to the axis, at which the filter is relatively ineffective and all light (e.g. both infra-red and visible light from the lamp) is output for illumination purposes. According to a further specific feature of the invention, a light seal is provided which avoids undesired (e.g. infra-red) light spill-out when the filter is in the transverse position.

In addition, the light assembly may be selectably used as a flood-lamp or a spot-light, by moving the lamp bulb assembly in an axial direction.

BRIEF DESCRIPTION OF THE DRAWINGS

The nature and advantages of the present invention will become more readily apparent upon consideration of the following description of a preferred embodiment taken in conjunction with the appended drawings, in which.

DETAILED DESCRIPTION OF THE DRAWINGS

Figure 1:
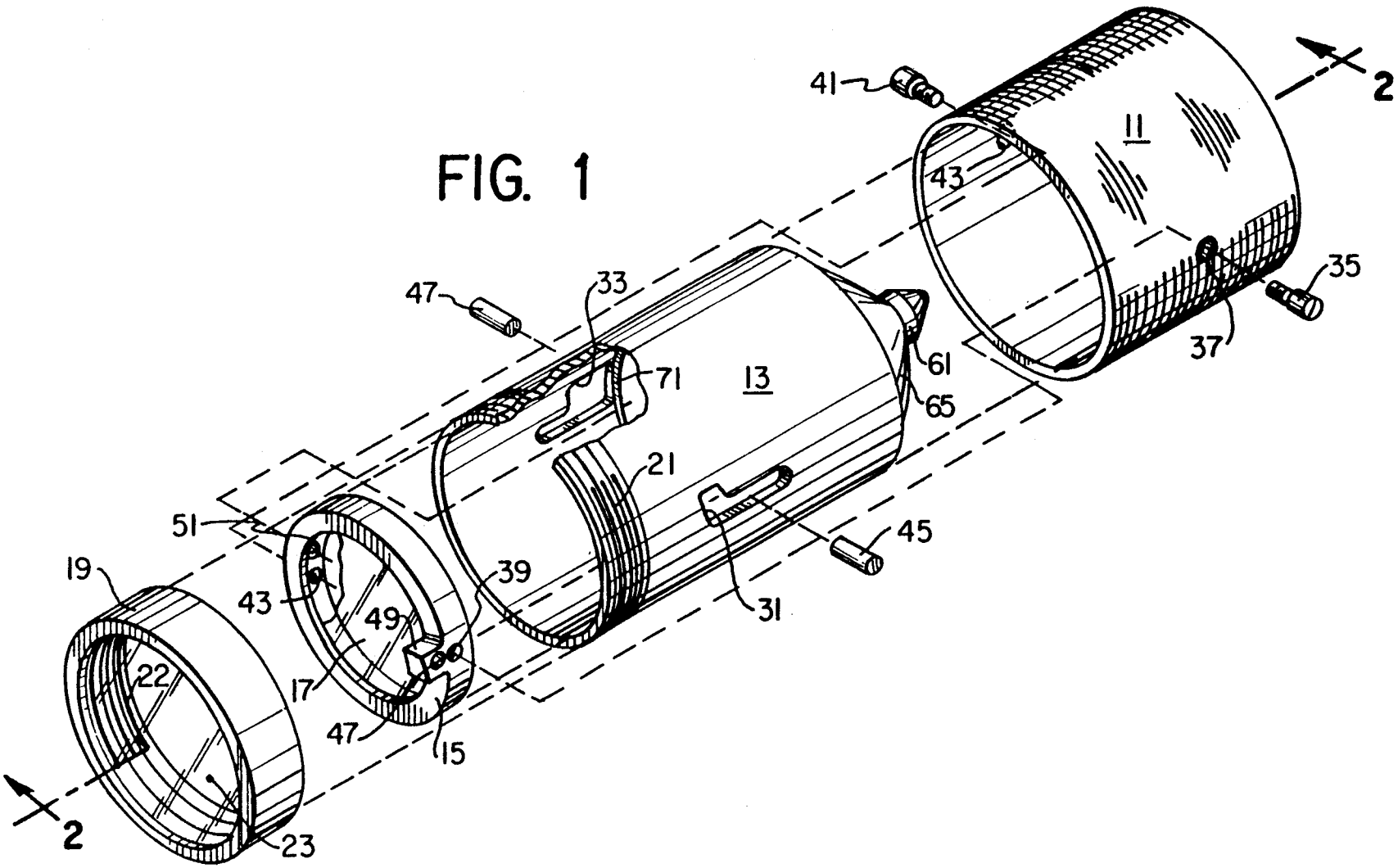
FIG. 1 is an exploded perspective view partially broken away showing various components of the present light assembly.
Figure 2:
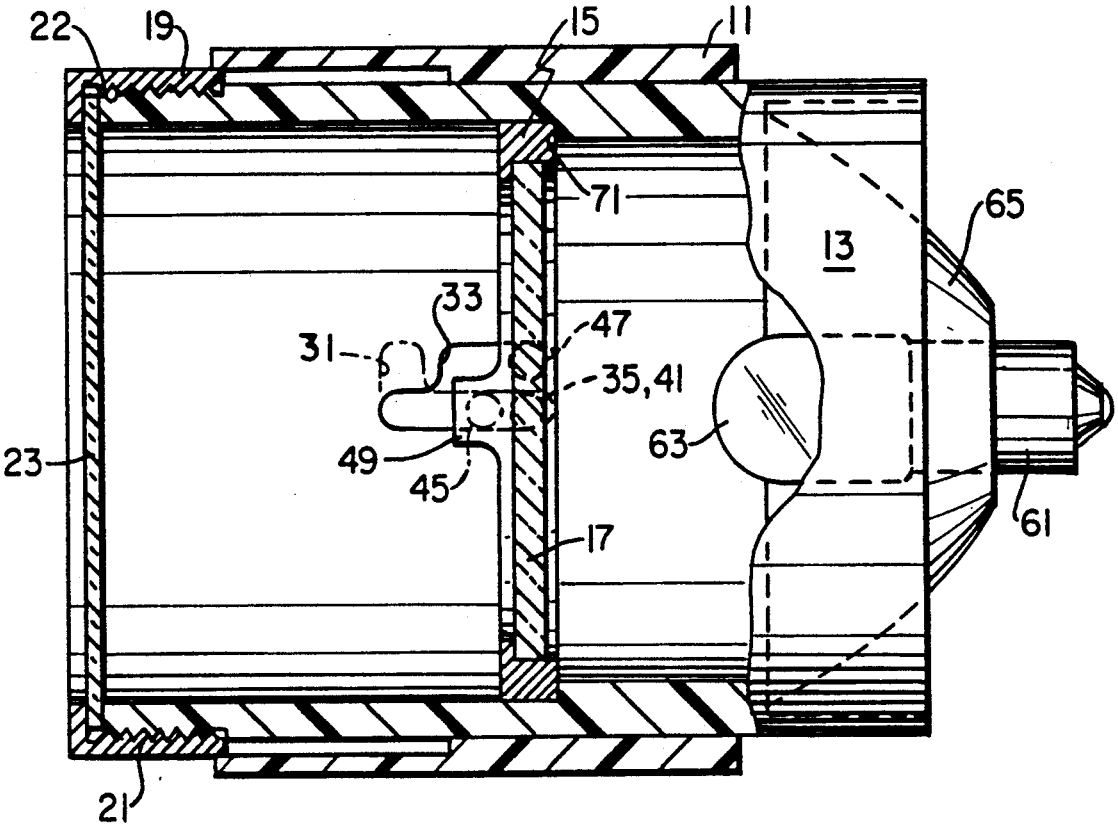
FIG. 2 is a longitudinal view of the present light assembly partially in section, viewed along line 2—2 of FIG. 1, showing the filter carrier in transverse position.

Referring to FIGS. 1 and 2, the present light assembly comprises an actuator tube 11 which slidably surrounds a front housing 13. A filter carrier 15 carries a filter plate 17 which is transparent, but blocks a selected type of light (e.g. infra-red light) while passing other light (e.g. visible white light). An end cap 19 has internal threads 22 which engage threads 21 on the front housing. Cap 19 may include a transparent plate 23 which will pass both infra-red and visible light, and serves primarily as a seal against moisture and dust.

The front housing 13 is provided with a left or near-side camming aperture 31 on one side and a right or farside camming aperture 33 on the opposite side. A left pivot pin 35 passes freely through an opening 37 in actuator tube 11 and aperture 31, and as schematically indicated by the dashed line in FIG. 1 is secured (as by being press-fitted or threaded) into an aperture 39 on the filter carrier 15. A right pivot pin 41 similarly passes freely through opening 43 in actuator tube 11 aligned diametrically opposite to opening 37 and through aperture 33. As indicated by the dashed line, pivot pin 41 is fixed to filter carrier 15 at a position 43 diametrically opposite to pin 35.

Also fixed to the filter carrier are a pair of camming pins 45 and 47. Camming pin 45 is fixed to filter carrier 15 at a position axially advanced from pivot pin 35 at aperture 39, as in an opening 47 carried on an axially extending boss 49 on filter carrier 15. Camming pin 47 is secured to filter carrier 15 at an opening 51 which is circumferentially displaced from the pivot pin 41 and its aperture 43. Thus, the camming pins 45 and 47 are not diametrically opposite one another but slightly displaced from one another in both an axial direction and a circumferential direction.

As shown more clearly in FIG. 2, a light assembly comprising a lamp socket 61, a lamp bulb 63 and a reflector 65 is suitably mounted in the right end of the housing 13 in conventional manner. Preferably, this light assembly provides means for converting the illumination from a flood-light to a spot-light type illumination. This may be readily done by making the lamp 63 and socket 61 adjustable axially with respect to the reflector 65 in a desired manner. Preferably the lamp and socket structure are provided with two fixed positions (i.e. for flood lighting or spot lighting) each of which may be maintained by a suitable detent arrangement.

FIG. 2 shows the filter carrier 15 in its transverse position where it rests against a shoulder 71 formed in the front housing 13, thereby providing a good light seal to prevent infra-red light from the light assembly 61, 63 from passing through the end cap 23 forming the light outlet of the light assembly.

Figure 3:
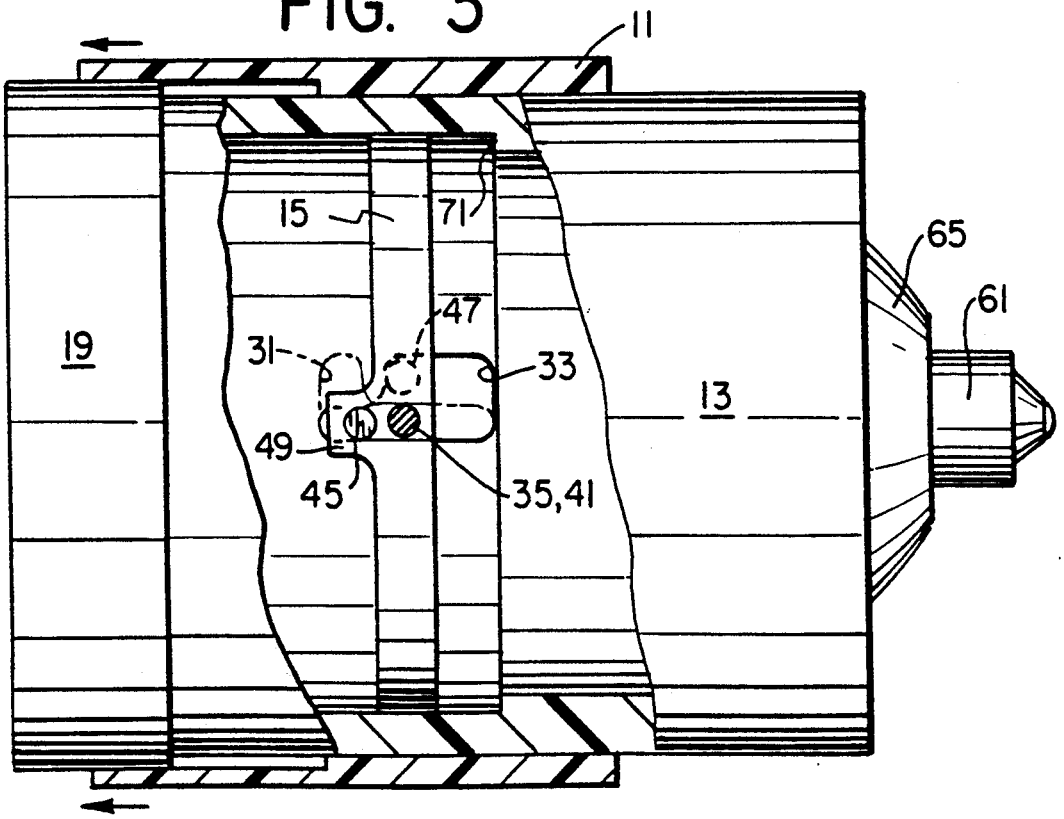
FIG. 3 is a longitudinal view of the light assembly of the present invention, similar to FIG. 2, with the actuator tube displaced partially to the left from the position in FIG. 2.
Figure 4:
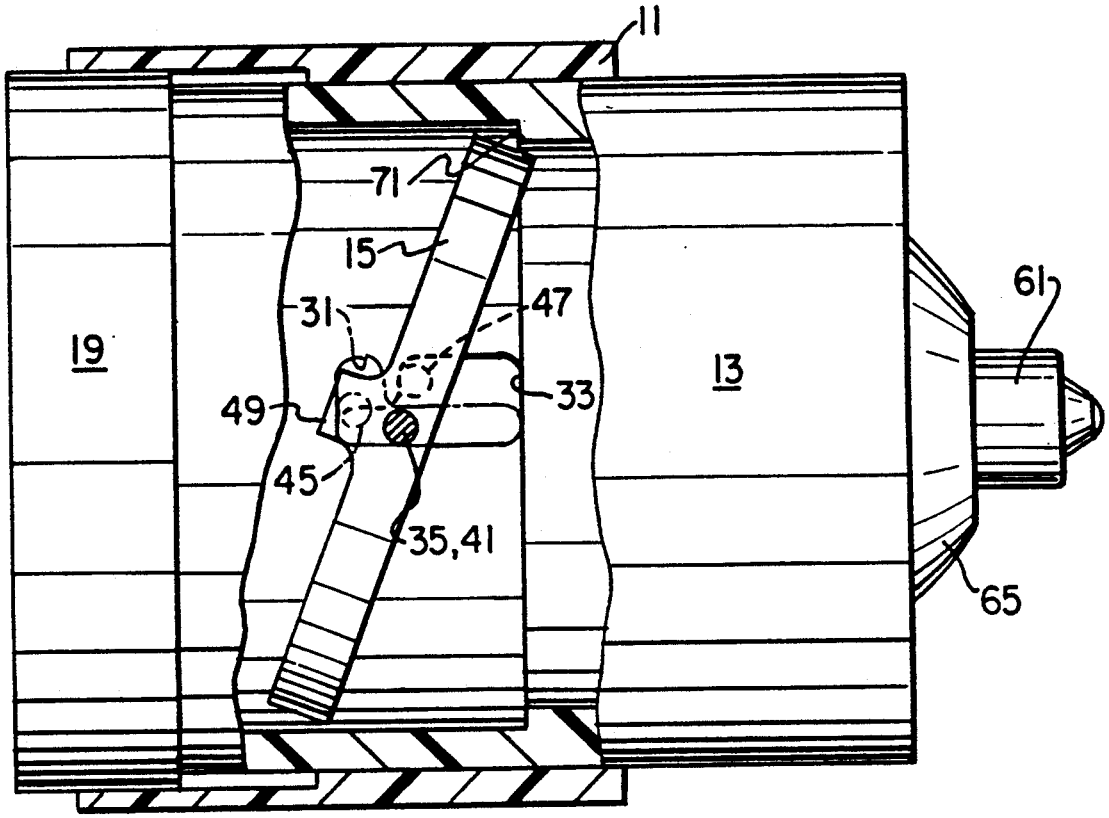
FIG. 4 is a similar longitudinal view of the light assembly of the present invention partially in section, with the filter carrier partially rotated and the actuator tube further displaced to the left with respect to FIG. 3.
Figure 5:
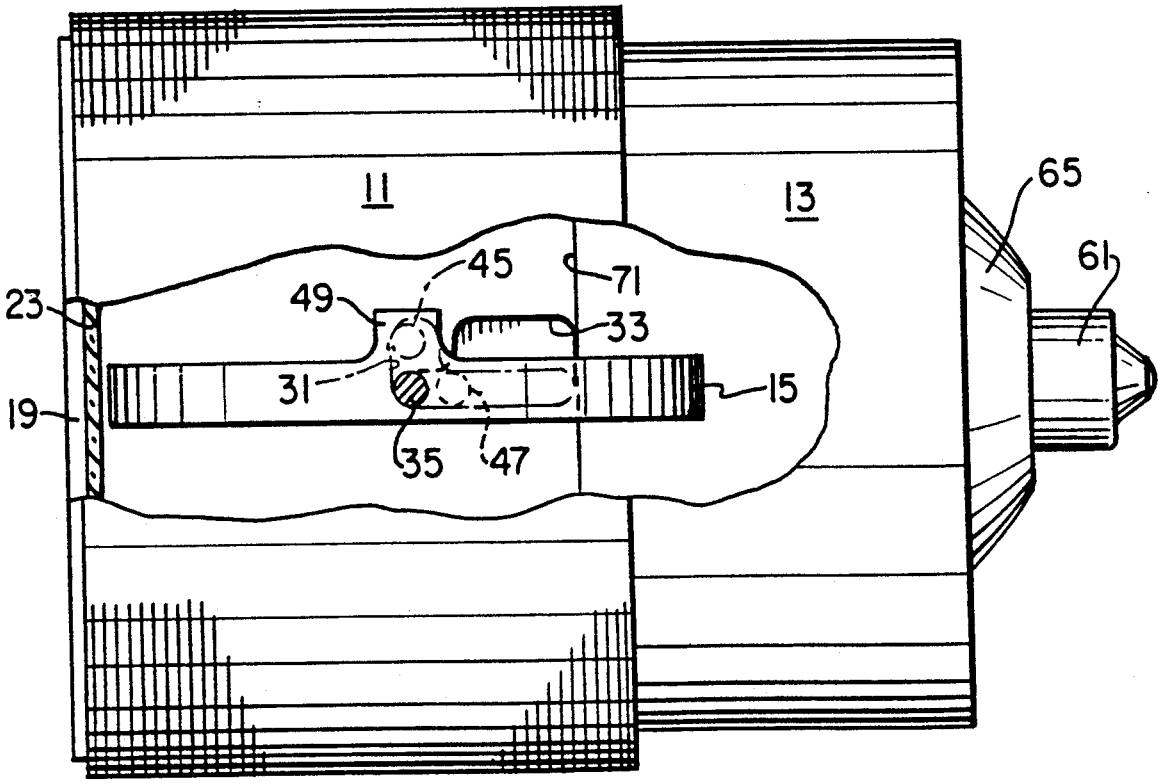
FIG. 5 shows a similar longitudinal view of the light assembly partially broken away, with the actuator tube fully displaced to the left, and the filter carrier in its full axial position.

The manner in which the filter carrier 15 is flipped to the axial position shown in FIG. 5 (where it is in the unfiltered position) may best be understood from FIGS. 2 to 5, showing successive states of the apparatus during the changeover from filtered to unfiltered positions, and from FIGS. 2A to 5A showing the left camming aperture 31 (in solid line) and the right camming aperture 33 (in dot-dash line), in relation to the pivot pins 35, 41 and the camming pins 45 and 47, for each of the respective positions of FIGS. 2 to 5.

Figure 2A:
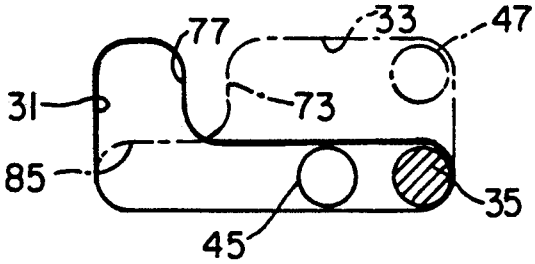
FIG. 2A is a schematic diagram showing the pin and camming aperture relationship with the filter carrier in the position of FIG. 2.

In the position shown in FIGS. 2 and 2A, the pivot pins 35, 41 are at the rear ends of the respective camming aperture 31, 33. As previously indicated the camming pin 45 is slightly in advance (toward the front) in relation to pivot pin 35 while the camming pin 47 is slightly above, but at the same axial position as the pivot pins 35, 41.

Figure 3A:
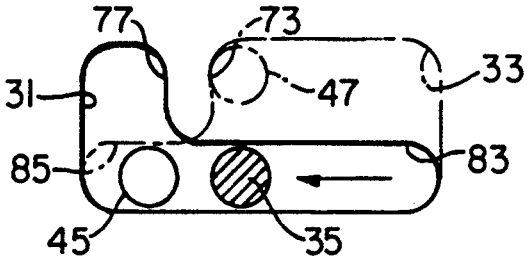
FIG. 3A is a schematic diagram showing the pin and camming aperture relationship with the filter carrier in the position of FIG. 3.

As the actuator tube 11 is moved towards the left, it moves pivot pins 35, 41 to the left, which move the filter carrier 15 to the left with its cam pins 45, 47, to a position such as shown in FIG. 3 and 3*a*. During this movement, pivot pins 35, 41 and cam pins 45, 47 move freely within the camming apertures 31,33, and the filter carrier does not rotate, but separates axially from shoulder 71 to permit subsequent rotation.

Figure 4A:
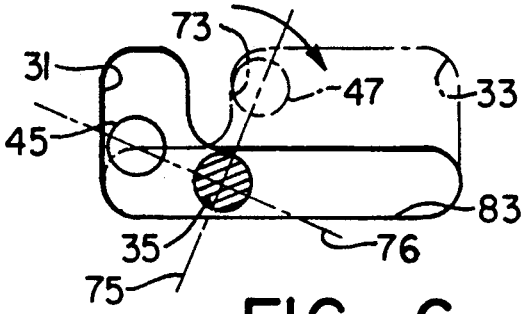
FIG. 4A is a schematic diagram showing the pin and camming aperture relationship with the filter carrier in the position of FIG. 4.

Further movement of the actuator tube 11 moves the pivot pins 35, 41 forward. As indicated in FIG. 4A, aperture 31 comprises a groove portion 83 adapted to confine pivot pin 35 to axial sliding movement. However, as seen in FIG. 3A the right camming pin 47 is restrained from forward movement by the edge 73 of the right aperture 33. As a result, as pivot pin 35 is moved forward, the filter carrier 15 is cause to pivot about the pin 47 which slides down on edge 73, as illustrated in FIGS. 4 and 4A. Since the plane of the filter carrier 15 is substantially coincident with the line 75 joining pivot pin 35 and camming pin 47, the filter carrier 15 is therefore tilted from the transverse position of FIGS. 2 and 3, to an intermediate position shown in FIGS. 4 and 4A. The initial translatory displacement of the filter carrier 15 (from the position of FIG. 2 to that of FIG. 3) permits the edge 16 of filter carrier 15 to clear the shoulder 71 to permit the rotary movement illustrated in FIG. 4.

Figure 5A:
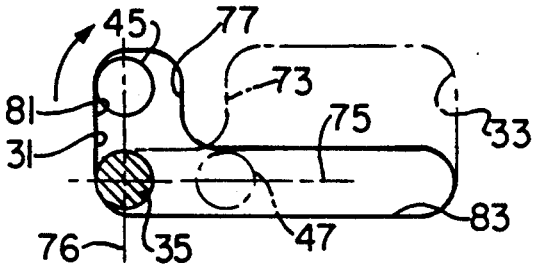
FIG. 5A is a schematic diagram showing the pin and camming aperture relationship with the filter carrier in the position of FIG. 5.

By further displacement of the actuator tube 11 and pivot pins 35, 41 to the left, as the farside cam pin 47 leaves the cam surface 73 of aperture 33, the nearside cam pin 45 engages the edge 81 of its aperture 31 so that further forward movement of the pivot pins 35, 41 causes the cam pin 45 to ride up the edge 81, which turns the filter plate about the pivot pins 35, 41, to the position of FIGS. 5 and 5A, at which the pivot pin 35 abuts the end edge 81 of the camming aperture 31 and the camming pin 47 has moved down off the edge 73 of camming aperture 33. In this position, the engagement of camming pin 45 abutting the end edge 81 of the camming aperture 31 causes the plane of the filter carrier 15 (represented by line 75 joining the centers of pins 35 and 45) to be now parallel to the axis of the light assembly, permitting full unfiltered illumination through end cap 19. It will be seen that aperture 31 also has a channel 85 (see FIG. 2A) with a width only slightly larger than the diameter of pin 41 which constrains the pin 41 to move only axially, to accomplish the pivoting action described. Thus, the combination of channel 85 of aperture 31 and channel 83 of aperture 33, allows pivot pins 35, 41 to move only axially, causing axial movement of filter carrier 15 before and while it is pivoting about pins 35, 41.

To retract the actuator tube 11 for restoring the filter carrier 15 to its transverse (e.g. infra-red blocking) position, the camming pin 45 cooperates with the camming edge 77 of aperture 31, as seen in FIG. 5A.

As the actuator tube 11 is moved rearward, the pivot pins 35, 41 are constrained by channels 83, 85 to move axially rearward, and carry the filter carrier 15 rearward with the cam pins 45, 47, until pin 45 engages edge 77. Again, pin 41 is constrained for only axial movement, thereby causing cam pin 45 to ride down edge 77 and cam pin 47 to move upward into aperture 33. This pivoting action is the reverse of that described above for forward movement of actuator tube 11, and progressively moves the filter carrier through the stages shown in FIGS. 4A and 3A. At the stage of FIG. 3A, cam pin 45 is disengaged from edge 77 of aperture 31, and further movement of actuator tube 11 translates the filter carrier 15 axially into sealing engagement with shoulder 71.

It will be seen that the channels 85 and 83 in which the pivot pins 35, 41 ride in response to a movement of the actuator tube 11 will maintain the filter carrier 15 and filter 17 centered within the front housing 13, subject only to being pivoted about pivot pins 35, 41 by the action of the cam pins 45, 47, in their respective camming apertures 31, 33. The portion of the filter carrier 15 between the pivot pin 35 and the cam pin 45 (along line 76 of FIG. 4A) may be considered to be one arm of a bell crank whose other arm is the portion of the filter carrier 15 along line 75 between the cam pin 47 and the pivot pin 41 (which is in effect an axial extension of pivot pin 35). This arrangement therefore provides that the filter carrier has two bell crank arms extending substantially at right angeles to one another and joined at the pivot axis 35, 41. The apertures 31, 33 provide in effect cam edges or surfaces which cause the bell crank to pivot approximately 90 degrees upon axial translation of the actuator tube 11 carrying the pivot axis 35, 41 and filter carrier relative to the housing 13. This arrangement maintains a relatively dust-proof and light-proof assembly, since the actuator tube 11 covers all of the apertures in the side walls of the front housing 13, and also reduces the possibility of undesired light leakage.

The present arrangement permits the filter plate to slide forward without pivoting from the position of FIG. 2 to that of FIG. 3, to permit the edge of the filter plate to clear the shoulder 71 before pivoting is attempted. This assures that a light tight-seal is maintained when the filter plate is in the position of FIG. 2 while also permitting the desired pivoting to the position of FIG. 5.

For changing the illumination provided by the light assembly, as between a flood-light condition and a spot-light condition, the lamp bulb 63 may be displaced linearly with reference to its reflector 65. For this purpose, a rotatable sleeve may be mounted on the rear end of the front housing 13 and provided with a series of helical slots. The lamp mount 61 may have a plurality of (e.g., two or three) fixed pins protruding radially through longitudinal slots in housing 13 and the helical slots of the sleeve. When the sleeve tube with its helical slots is rotated relative to the actuator tube, these pins are forced to displace longitudinally due to restriction of the straight slots in the housing tube. This moves the lamp mount 61 axially relative to reflector 65, to shift between spot-light and flood-light positions.

Figure 6:
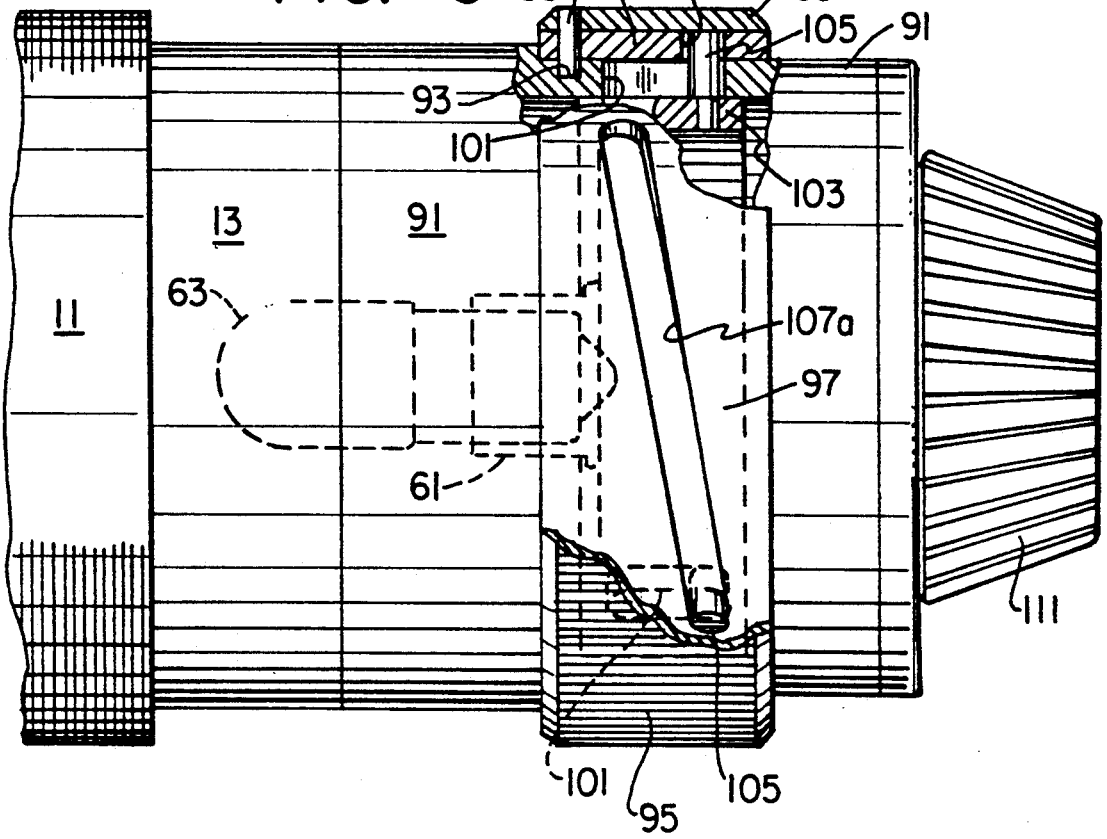
FIG. 6 is an elevation view partly in section and partly broken away, of the focusing arrangement of the present invention.

FIG. 6 shows a arrangement for accomplishing this result. Suitably fixed to the rear end of the front housing 13 is a back housing 91 which has an annular groove 93 extending around it. Surrounding the back housing 91 is a composite ring having an outer ring portion 95 and an inner ring portion 97. A plurality of pins 99 join the outer and inner ring portions 95, 97. Pins 99 extend into and are slidable within the annular groove 93 so that the rings 95, 97 are rotatable about the axis of the unit, but cannot move axially with respect to the back housing 91.

The rear housing 91 has a set of preferably equally spaced longitudinally extending slots, one of which is shown in section and another in dotted lines, at 101. There may, for example, be three such slots 101 at 120-degree intervals around the periphery of rear housing 91. Within the rear housing 91 is a movable focusing cup or ring 103 which carries a plurality of pins 105 each slidable within a corresponding one of the axial slots 101.

Inner ring 97 also has a set of helical slots extending around it periphery. For example, there may be three such slots, spaced 120 degrees apart, and each extending over approximately a 90 degree arc. One such slot is shown at 107*a* in elevation, while a second slot 107*b* is shown in the fragmentary cross-section at the top of the figure. As shown each of the pins 105 rides in a respective one of the helical slots 107.

Suitably attached to the focusing cup 103 (in conventional manner, not shown) is the lamp socket mount 61 carrying the lamp bulb 63. The reflector 65 (not shown in FIG. 6) is fixedly mounted in the front housing 13 as indicated in FIG. 2.

By virtue of this structure, rotation of outer ring 95 causes its slots 107 to advance or retard the pins 105 by the camming action of the slots 107 on the pins 105. This causes the lamp and socket assembly 61, 63 to advance or recede axially along the apparatus, with respect to the reflector 65, to shift between a spot-light condition and a flood-light condition, depending upon the position of the lamp bulb 63 relative to reflector 65.

Also shown in FIG. 6 is a knob 111 which may actuate a rheostat supported in the rear housing 91 (not shown). In conventional manner the rheostat may be connected in series with the lamp bulb 63 to permit dimming the light output a desired. The rheostat may include an off/on switch, in customary manner.

It will therefore be seen that the present invention provides a compact unit with a filter selectably positionable in front of a light source, which may be a flood light or a spot light, with all controls being readily accessible on the outer periphery of the unit.

It will be understood that the present invention is not limited to use for infra-red night-vision, but may be utilized wherever it is desired to selectably place a filter in the path of a light source.

While a preferred embodiment of the present invention has been described above it is to be understood that the invention is not to be deemed limited thereto, but is defined by the following claims.

What is claimed as the invention is:

1. A filterable light assembly comprising:

a housing member, a light source in said housing member for producing light along a path, an actuator member slidable with respect to said housing member, a filter carrier mounted for translatory movement together with said actuator member relative to said light source, for blocking a predetermined portion of light from said source, said filter carrier being pivotable relative to said actuator member between a first position transverse to said light path to block light from said light source and a second position substantially parallel to said path to allow substantially full passage of light from said light source, and cooperating means on said housing and said filter carrier responsive to said movement of said actuator member for causing said filter carrier to pivot between said first and second positions.

2. A light assembly as in claim 1 where said cooperating means comprises a pivot pin on said filter carrier, an aperture in said housing and an aperture in said actuator member, said pin passing through both said apertures.

3. A light assembly as in claim 2 wherein said cooperating means comprises a bell crank arrangement on said filter carrier.

4. A light assembly as in claim 1 wherein said cooperating means comprises a bell crank arrangement on said filter carrier.

5. A light assembly as in claim 4 wherein said bell crank arrangement comprises a first pair of pins on one side of said filter carrier and a second pair of pins on the other side of said carrier, the line joining said first pair of pins being substantially perpendicular to the line forming the second pair of pins.

6. A light assembly as in claim 5 further comprising apertures in said housing through which said pins extend, said apertures having edges cooperable with said pins to cause said filter carrier to pass in response to movement of said actuator member between a first carrier position transverse to the path of light emitted from said light source to a second carrier position substantially parallel with said path.

7. A light assembly as in claim 1 wherein said housing has a first aperture on one side thereof and a second aperture on the other side thereof, said filter carrier has a pivot pin extending outwardly through each of said apertures, said filter carrier also having a first cam pin, adjacent to but axially spaced from one of said pivot pins and also has a second cam pin adjacent to but peripherally spaced from the other of said pivot pins.

8. A light assembly as in claim 7 wherein said first aperture has an edge cooperable with one of said cam pins to cause said filter carrier to pivot through a first angle about said pivot pins upon translation of said actuator member and said carrier.

9. A light assembly as in claim 8 wherein said second aperture has an edge periphery cooperable with the other of said cam pins to cause said filter carrier to pivot about said pivot pins through a second angle supplementing said first angle upon further translation of said actuator member and said filter carrier.

10. A light assembly as in claim 1 wherein said housing member has a shoulder, said filter carrier conforming to said shoulder to form a light seal for light emitted from said source, said cooperating mens being responsive to movement of said actuator member to cause said filter carrier to translate away from said shoulder while transverse to the path of said light and upon further movement of said actuator member to pivot to a position substantially parallel to said path.

11. A light assembly as in claim 1 further including a reflector for said light source, means for moving said light source and reflector relative to one another between a first position producing a flood-light type of illumination and a second position producing a spot-light type of illumination.

12. A light assembly as in claim 1 wherein said light source comprises a lamp bulb, a reflector, and means operable outside said housing for moving said lamp bulb and reflector relative to one another to vary the spread of light output from said assembly.

13. A light assembly as in claim 12, wherein said latter means comprises a ring rotatable relative to said housing, a member supporting said lamp bulb within said housing, said member having a helical slot therein, an axial slot in said housing, a pin fixed to said member and slidable in both said slots whereby rotation of said ring causes axial movement of said member and lamp bulb.

14. A cockpit light assembly for selectably either barring illumination by infra-red light from a light source or having both visible and infra-red light, comprising:

an actuator member, a filter adapted to block infra-red light while passing visible light, a carrier for said filter pivotally supported within said actuator member, a housing surrounding said filter carrier, said housing having camming apertures therein on opposite sides thereof, and a camming pin passing through each of said apertures and secured to said filter carrier, whereby slidable movement of said actuator member translates said filter carrier within said housing, said apertures and camming pins being arranged to cause said pins to pivot said filter carrier upon translation of said actuator member.

15. Apparatus as in claim 14, further comprising pivot pins on said carrier wherein said apertures have channels confining said pivot pins to movement along the axis of said light source.

16. A cockpit light assembly for selectively blocking infra-red light from a light source producing both visible and infra-red light, comprising a tubular housing supporting said light source, an actuator tube slidably surrounding said housing, an infra-red filter, a carrier for said filter pivotally supported by said actuator tube within said housing, said housing having an axially extending aperture on either side of the housing, a pair of pivot pins passing through said actuator tube and respective aperture and secured to said filter carrier, a first cam pin secured to said filter carrier on one side thereof axially spaced from one of said pivot pins, a second cam pin secured to said filter carrier opposite said first pin and circumferentially spaced from said second pivot pin, the aperture for said first cam pin having a circumferentially extending extension at the forward end thereof, the aperture for said second cam pin having a circumferentially extending extension at the rearward end thereof, whereby axial translation of said actuator tube will cause said cam pins by engagement with their respective apertures to cause said filter carrier to pivot about said pivot pins.

* * * * *